US006971915B1

(12) United States Patent
Mao et al.

(10) Patent No.: US 6,971,915 B1
(45) Date of Patent: Dec. 6, 2005

(54) ELECTRICAL CONNECTOR WITH STEADY MATING FRAME

(75) Inventors: Yu-Hua Mao, Kunsan (CN); Chun-Sheng Li, Kunsan (CN); Feng Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/106,389

(22) Filed: Apr. 13, 2005

(30) Foreign Application Priority Data

Jul. 22, 2004 (CN) ..... 2004200780679 U

(51) Int. Cl.[7] ..... H01R 13/648
(52) U.S. Cl. ..... 439/607
(58) Field of Search ..... 439/607

(56) References Cited

U.S. PATENT DOCUMENTS 5,219,294 A 6/1993 Marsh et al.
5,401,189 A 3/1995 Sato
5,738,541 A * 4/1998 Tseng ..... 439/567
5,865,645 A * 2/1999 Embo et al. ..... 439/567
6,033,263 A * 3/2000 Weidler et al. ..... 439/620
6,210,225 B1 * 4/2001 Cai et al. ..... 439/607
6,210,226 B1 * 4/2001 Zhu et al. ..... 439/607
6,231,384 B1 * 5/2001 Kuo ..... 439/545
6,257,914 B1 * 7/2001 Comerci et al. ..... 439/357
6,319,026 B1 * 11/2001 Chen et al. ..... 439/108
6,682,368 B2 * 1/2004 Murr et al. ..... 439/607
6,692,294 B2 * 2/2004 Kobayashi ..... 439/496
6,709,286 B1 * 3/2004 Korsunsky et al. ..... 439/557
6,764,339 B2 * 7/2004 Kubo ..... 439/607

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector includes an insulative housing, which includes a base section and at least two spaced and parallel longitudinal mating tongues projecting from a front face of the base section, a plurality of terminals attached on opposite surfaces of each mating tongue and a shell attached to the insulative housing. The insulative housing is provided with at least a transverse rib interconnecting corresponding longitudinal ends of the mating tongues to define a first mating frame. The shell is provided with a frame section independently serving as a second mating frame. The second mating frame surrounds the first mating frame to define an annular recess therebetween.

6 Claims, 4 Drawing Sheets

ELECTRICAL CONNECTOR WITH STEADY MATING FRAME

BACKGROUND OF THE INVENTION

1. Field of the Invention

The present invention relates to an electrical connector, and more particularly to an electrical connector having a mating frame for reliably mating with a complementary connector. The instant application relates to a contemporaneously filed application titled "ELECTRICAL CONNECTOR WITH STEADY SHELL" having the same applicants and the same assignee with the instant application.

2. Description of the Prior Art

Portable or lap top computer have become quite popular in recent years, for travelers requiring access to a computer while out of the office. One of disadvantage of the lap top computers is that, due to their compact nature, the computers cannot contain the electronics of a desk top computer. Therefore, in order to perform the same capabilities as a desk computer, the lap top computer generally employ a high density connector serving as a docking for electrically connecting a cable connector assembly serving as a sailer of a periphery equipment.

Commonly, the docking connector provided on the lap top computer is configured in a low and thin profile with a longitudinal thin mating tongue due to the limited space in the lap top computer. Once mis-engagement happens between the cable connector assembly and the docking connector or the cable connector assembly happens to be shaken after engagement, the frailly mating tongue is apt to be adversely effected and even destroyed.

Hence, a steady mating frame of an electrical connector is desired to overcome the disadvantages of the prior art.

SUMMARY OF THE INVENTION

Accordingly, an object of the present invention is to provide an electrical connector, and particularly to an electrical connector having a steady mating frame reliably engaging with a complementary cable connector assembly.

To achieve the above objects, an electrical connector includes an insulative housing, which includes a base section and at least two spaced and parallel longitudinal mating tongues projecting from a front face of the base section, a plurality of terminals attached on opposite surfaces of each mating tongue and a shell attached to the insulative housing. The insulative housing is provided with at least a transverse rib interconnecting corresponding longitudinal ends of the mating tongues to define a first mating frame. The shell is provided with a frame section independently serving as a second mating frame. The second mating frame surrounds the first mating frame to define an annular recess therebetween.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
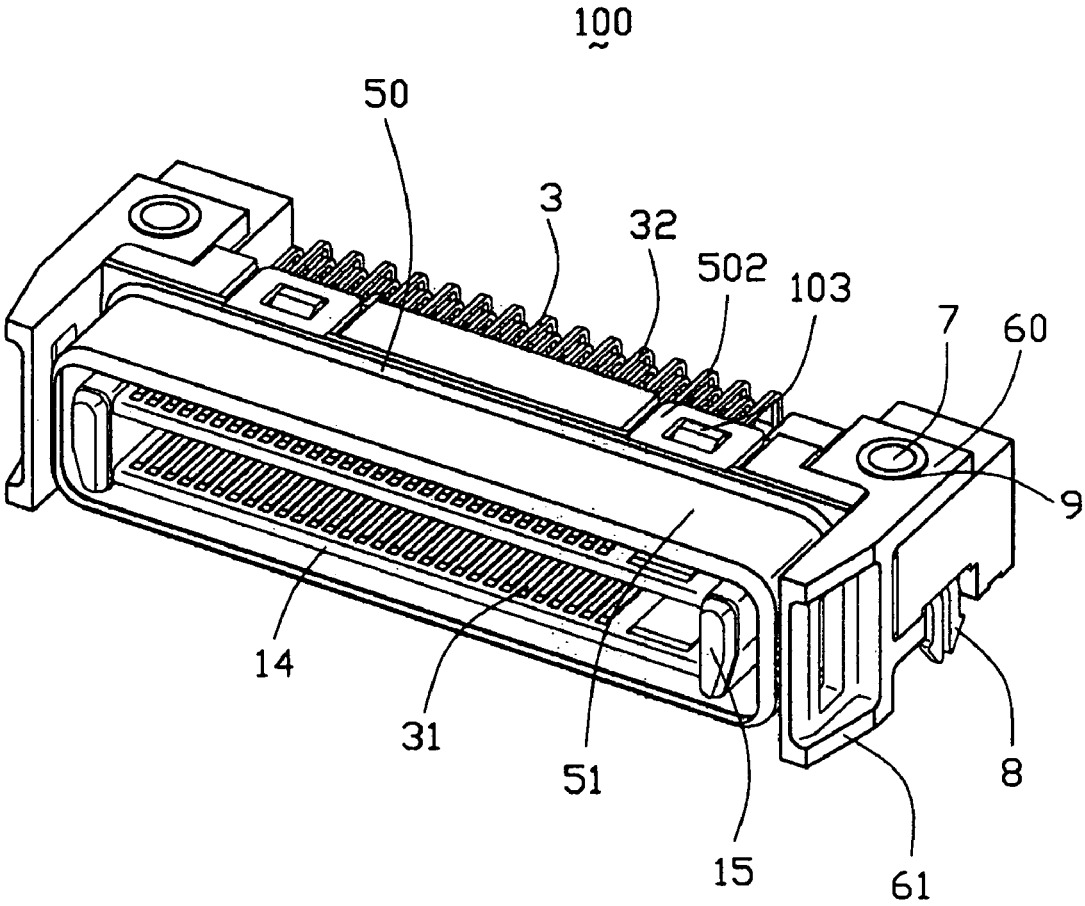
FIG. 1 is an assembled perspective view of an electrical connector in accordance with the present invention.

Referring to FIG. 1, an electrical connector 100 of the present invention is adapted for mounting onto a Print Circuit Board (PCB) (not shown) and serves as a docking of the PCB to electrically connect with a cable connector assembly (not shown) which serves as a sailer of a periphery equipments.

Figure 3:
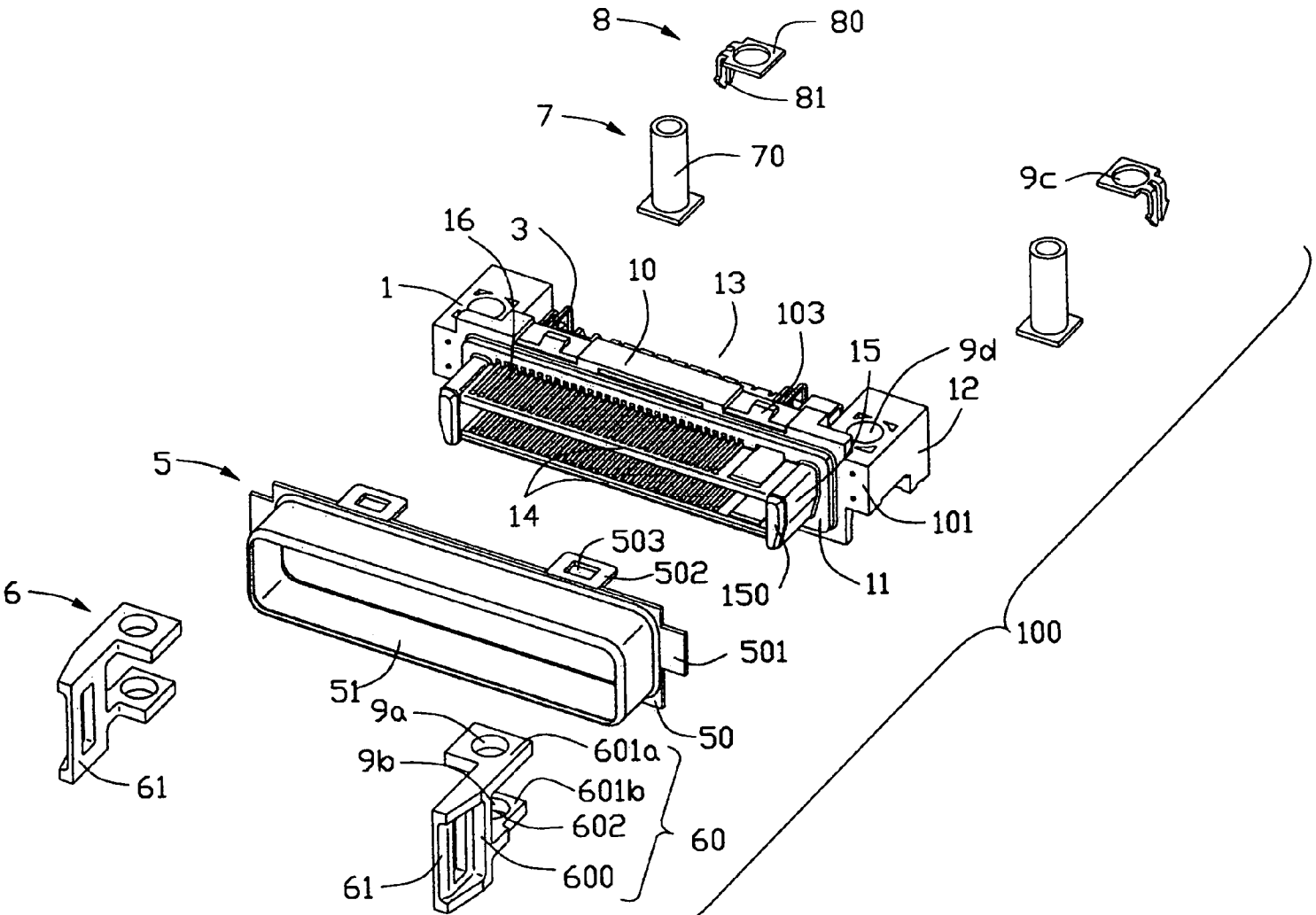
FIG. 3 is an exploded perspective view of the electrical connector shown in FIG. 1.
Figure 4:
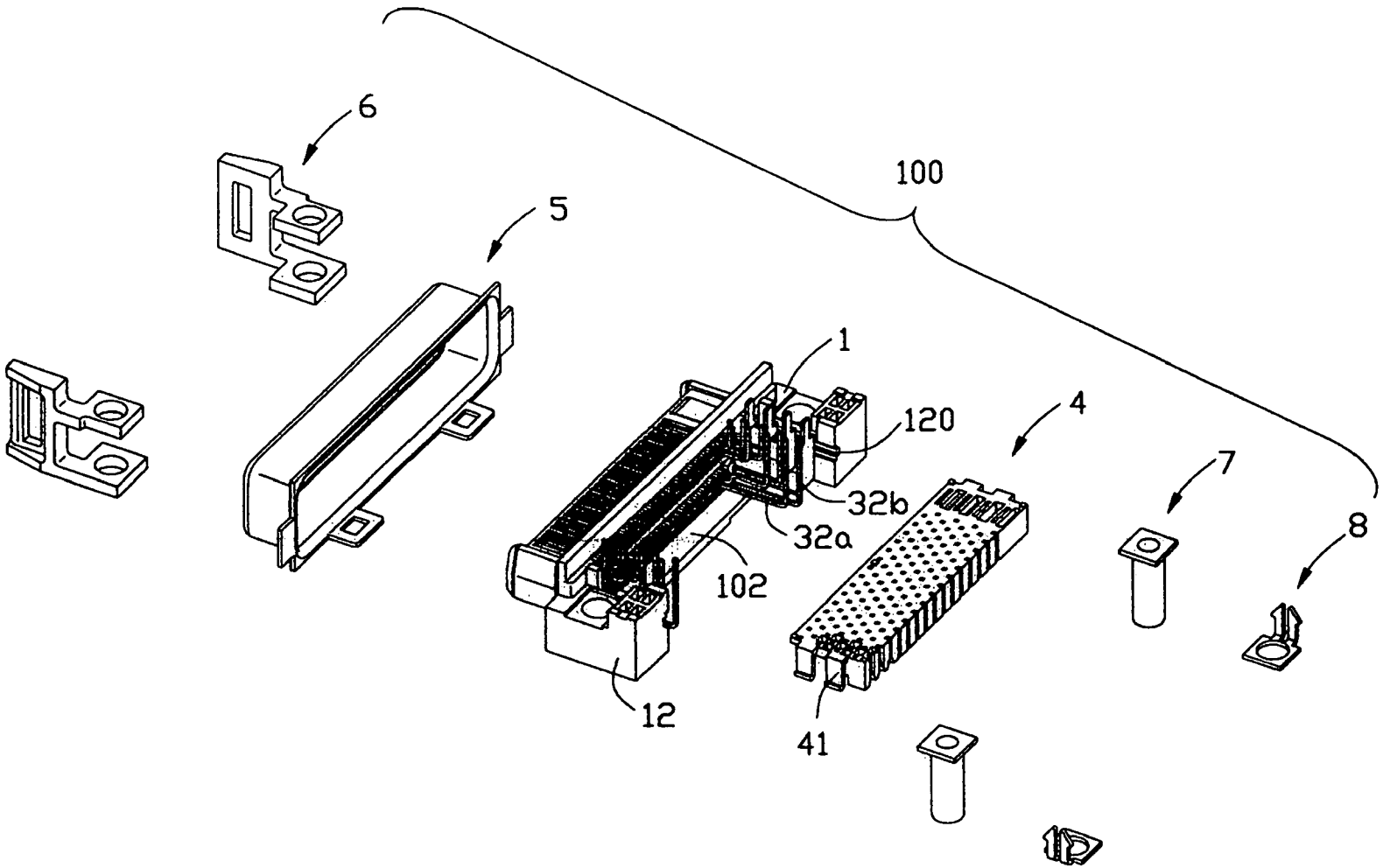
FIG. 4 is an exploded perspective view of the electrical connector shown in FIG. 2.

The electrical connector 100 comprises a unitarily molded insulative housing 1, as shown in FIGS. 3 and 4. The insulative housing 1 includes an elongated intermediated base section 10 having a front face 101 and an opposite rear face 102. A platform 11 is provided to appreciably protrude forwardly from the front face 101 of the base section 10 and a pair of legs 12 is provided to extend rearwardly from opposite ends of the rear face 102 of base section 10. A receiving space 13 is defined between the spaced legs 12 and the base section 10. The insulative housing 1 is further provided with a pair of parallel and spaced longitude mating tongues 14 extending forwardly from the platform 11. Generally, the mating tongue 14 is apt to be destroyed due to the thin configuration. Thus, the corresponding longitude ends of the mating tongues 14 are respectively interconnected by a pair of transverse ribs 15, whereby a steadily first mating frame is defined to engage with a mating port of the complementary cable connector assembly. Each transverse rib 15 is formed with a tip 150 extending beyond a mating face defined by the first mating frame for guiding purpose. Each transverse rib 15 is configured in dissymmetric cross-section shape, such as taper, for anti-mating with the complementary cable connector assembly.

Figure 2:
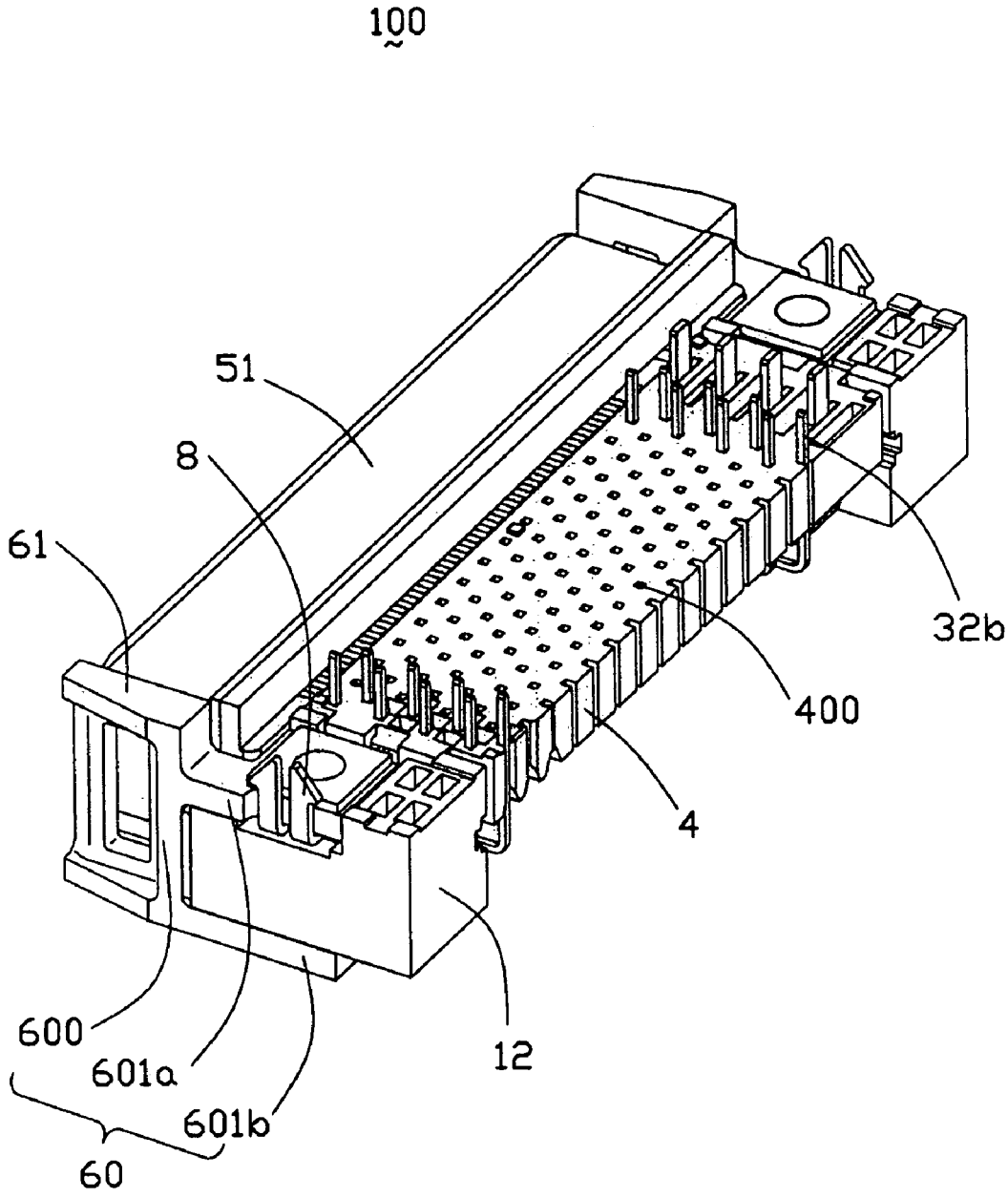
FIG. 2 is an assembled perspective view of the electrical connector shown in FIG. 1 taken from another aspect.

A plurality of passageways 16 is defined on opposited mating surfaces of each mating tongue 14 and pass through the base section 10 to communicate with the receiving space 13. Referring to FIG. 1, a plurality of terminals 3 is loaded into the corresponding passageways 16 and each is provided with a contacting section 31 exposed on a mating surface of the mating tongue 14 and a tail 32 extending into the receiving space 13. Each tail 32 has a parallel section **32*a* and a vertical tine 32*b* perpendicularly extending beyond a mounting face of the insulative housing 1 shown in FIG. 4. As best shown in FIGS. 2 and 4, a spacer 4 is accommodated in the receiving space 13 to align tips of the tines 32*b* of the terminals 3. The spacer 4 is formed with a pair of latches 41 at opposite end thereof to engage with corresponding recesses 120 defined in inner faces of the legs 12, whereby the spacer 4 is securely held between the opposite legs 12**.

Referring to FIGS. 1 and 3, the electrical connector 100 further includes a shell 5 assembled to the insulative housing 1. The shell 5 is provided with a plate section 50 attached to the front face 101 of the base section 10 with a pair of ears 501 disposed at opposite longitude ends thereof. The plate section 50 is formed with a pair of flanges 502 extending rearwardly along an upper face of the base section 10. Each flange 502 define an aperture 503 locking with a corresponding protrusion 103 formed on the upper face of the base section 10 and cooperating with the ears 501 of plate section 50 for attaching the shell 5 to the insulative housing 1, as will be described hereafter. A frame section 51 projects from the plate section 50 with an inner edge of one end thereof adjacent to the plate section 50 fitly enclosing an periphery edge of the platform 11 and an free end thereof serving as a second mating frame section. The second mating frame section surrounds the first mating frame to define an annular recess therebetween for receiving corresponding portion of the complementary cable connector assembly.

The electrical connector 100 further includes a pair of locking blocks 6, and a pair of board lock 8 provided with a mounting ring 80 thereon. The locking blocks 6 is molded from metal material and the board lock 8 is stamped and formed from a metal sheet. Each locking block 6 is provided with a mounting section 60 adapted for being mounted onto the leg 12 and a hook 61 extending forwardly from the mounting section 60 for latching with the complement cable connector assembly. The mounting section 60 is formed with upper and lower spaced mounting arms 601*a*, 601*b* rearwarly extending from opposite ends of an interim section 600 of the mounting section 60 to define a space therebetween. The locking block 6 is assembled onto corresponding leg 12 together with the board lock 8.

Referring to FIGS. 1 and 2, in assembled state, a front end of the leg 12 and the mounting ring 80 provided on the board lock 8 are both retained in the space between the upper and lower mounting arms 601*a*, 601*b* with the upper mounting arm 601*a* abutting against an upper face of the leg 12 and the lower mounting arm 601*b* abutting against the mounting ring 80 provided on the board lock 8. Simultaneously, the ear 501 provided on the plate section 50 of the shell 5 is tightly sandwiched between the interim 620 of the mounting section 60 and the front face 101 of the base section 10, whereby the shell 5 is securely assembled onto the insulative housing 1. The board lock 8 is formed with a locking foot 81 extending beyond the mounting face of the insulative housing 1 for being fitted into a hole defined in the PCB. The shell 5 is combined with the locking block 6 and the board lock 8 to establish an integrated shielding system for protecting EMI.

A locking through hole 9 is formed by aligning holes 9*a*, 9*b* defined on the mounting arms 601*a*, 601*b*, a hole 9*c* defined on the mounting ring 80 and a hole 9*d* defined on the leg 12 of the housing 1 in assembled state. A fastener 7 is provided to be received in the locking through hole 9 by passing through the upper arm 601*a*, the leg 12, the ring 80 of the board lock 8 and the lower arm 601*b* in turn. The fastener 7 has a hollow post 70 passing through the locking through hole 9. The engagement is achieved by expanding a free end of the hollow post 70, thereby the locking block 6 and the board lock 8 is securely assembled onto the insulative housing 1.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector, comprising:

an insulative housing comprising a base section and at least two spaced and longitudinal mating tongues projecting from the base section, the insulative housing being provided with at least a transverse rib interconnecting corresponding longitudinal ends of the mating tongues to define a first mating frame;

a plurality of terminals attached on at least a surface of each mating tongue;

a shell attached to the insulative housing and provided with a frame section independently serving as a second mating frame, the second mating frame surrounding the first mating frame to define an annular recess therebetween;

a pair of locking blocks disposed at longitudinal opposite ends of the second mating frame and each formed with a forwardly extending hook spaced from the second mating frame;

wherein the shell is provided with a plate section attached to the base section, and wherein the plate section is formed with a pair of ears sandwiched between corresponding locking blocks and the base section;

a pair of board locks each having a mounting ring and a locking foot, wherein the lock block is formed with a pair of spaced mounting arms holding the base section and corresponding mounting ring of the board lock therebetween;

wherein the locking block and the board lock are both made of metallic material whereby combining shell with the locking block and the board lock to establish an integrated shielding system; and a fastener to fasten the locking block, the insulative housing and the board lock together.

2. The electrical connector as claimed in claim 1, wherein the transverse rib is formed with a tip projecting beyond a mating face defined by the first mating frame.

3. The electrical connector as claimed in claim 1, wherein the transverse rib is configured in a dissymmetric cross-sectional shape.

4. The electrical connector as claimed in claim 3, wherein the transverse rib has a tapering cross-section.

5. The electrical connector as claimed in claim 1, wherein at least a transverse rib comprises a pair of transverse rib.

6. An electrical connector for mating with a complementary connector comprising:

an insulative housing comprising a base section and a hollow mating section extending forwardly from said base section, defining a recess therein, and serving as an insulative mating frame, said mating section being of a four-sided polygon defining two opposite long sides and two opposite short sides located at two ends of said two long sides, respectively;

a plurality of terminals disposed in the housing and exposed upon at least a portion of said mating section in a vertical direction which is perpendicular to a mating direction of the connector with the complementary connector; wherein the two short sides extend forwardly beyond the two long sides, and said terminals are only disposed upon the two long sides rather than the two short sides; and a metallic shell attached to the insulative housing and provided with a frame section independently serving as a metallic mating frame, the metallic mating frame surrounding the insulative mating frame to define another recess therebetween;

wherein said mating section is essentially of a D-shaped configuration, and wherein said recess is of rectangle.

* * * * *